US010549290B2

(12) United States Patent
Romero

(10) Patent No.: US 10,549,290 B2
(45) Date of Patent: Feb. 4, 2020

(54) SWIRL POT SHOWER HEAD ENGINE

(71) Applicant: Spectrum Brands, Inc., Middleton, WI (US)

(72) Inventor: Oscar Romero, Lake Forest, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/703,566

(22) Filed: Sep. 13, 2017

(65) Prior Publication Data

US 2018/0071755 A1 Mar. 15, 2018

Related U.S. Application Data

(60) Provisional application No. 62/393,735, filed on Sep. 13, 2016.

(51) Int. Cl.

| | |
|---|---|
| ***B05B 1/00*** | (2006.01) |
| ***B05B 1/18*** | (2006.01) |
| ***B05B 1/34*** | (2006.01) |
| *E03C 1/04* | (2006.01) |

(52) U.S. Cl.

CPC ..... *B05B 1/185* (2013.01); *B05B 1/18* (2013.01); *B05B 1/341* (2013.01); *B05B 1/3421* (2013.01); *E03C 1/0408* (2013.01)

(58) Field of Classification Search

CPC ..... B05B 1/34; B05B 1/3405; B05B 1/341; B05B 1/3415; B05B 1/3421; B05B 1/3426

USPC ..... 239/461, 463, 466, 472, 468, 494

See application file for complete search history.

(56) References Cited

U.S. PATENT DOCUMENTS

| | | | | | |
|---|---|---|---|---|---|
| 715,044 | A | * | 12/1902 | Fisher | B05B 3/04 239/383 |
| 836,931 | A | * | 11/1906 | Koepnick | B05B 1/3415 239/117 |
| 969,657 | A | * | 9/1910 | Reade | B05B 1/3415 239/495 |
| 985,505 | A | * | 2/1911 | Brinkm | B05B 1/3415 239/495 |
| 1,007,793 | A | * | 11/1911 | Peabody | B05B 1/3436 239/494 |

(Continued)

FOREIGN PATENT DOCUMENTS

| | | | |
|---|---|---|---|
| CA | 2682588 | A1 | 4/2011 |
| CN | 203002500 | U | 6/2013 |
| CN | 103801467 | A | 5/2014 |

OTHER PUBLICATIONS

International Search Report and Written Opinion for International Application No. PCT/US2017/051378 dated Dec. 15, 2017 (8 pgs).

*Primary Examiner* — Viet Le
(74) *Attorney, Agent, or Firm* — Merchant & Gould P.C.

(57) ABSTRACT

A showerhead engine internally swirls water within a swirling chamber. Multiple swirling chambers may be used, each separated from one another. The water is swirled with angled through holes in a mid plate. As the water passes through the angled holes it is projected out at an angle. The water then contacts the swirling chamber wall and continues to follow the curvature of the wall. The curved wall paired with the angled entry causes the water to continue to swirl within the swirling chamber. The water is released out of the swirling chamber through slots, which allow the water to retain the angular velocity at a discharge angle.

20 Claims, 3 Drawing Sheets

(56) References Cited

U.S. PATENT DOCUMENTS 1,150,940 A * 8/1915 Irish ..... B05B 1/3436 239/494
1,150,960 A * 8/1915 Peabody ..... B05B 1/3436 239/494
1,216,630 A * 2/1917 Tuthill ..... B05B 1/3431 239/465
1,509,671 A * 9/1924 Fish ..... B05B 9/01 239/482
1,534,546 A * 4/1925 Ross ..... B05B 1/02 239/495
1,668,271 A * 5/1928 Fisk ..... B05B 1/02 239/490
1,716,733 A * 6/1929 Nelson ..... B05B 1/3415 239/465
1,756,483 A * 4/1930 Estep ..... B05B 1/3447 239/494
1,862,812 A * 6/1932 Thompson ..... B05B 1/3026 137/625.3
1,880,880 A * 10/1932 Dietsch ..... B05B 1/265 239/206
2,065,161 A * 12/1936 Thompson ..... B05B 1/3415 239/465
2,069,076 A * 1/1937 Majewski ..... B05B 1/3415 222/318
RE20,488 E 8/1937 Zinkil
2,114,709 A * 4/1938 Hlinsky ..... B05B 1/3415 239/492
2,187,779 A * 1/1940 Gardner ..... B05B 1/262 239/428.5
2,273,830 A * 2/1942 Brierly ..... B05B 1/34 239/472
2,284,264 A * 5/1942 Crisp ..... B05B 1/3436 239/466
2,308,476 A * 1/1943 Gerrer ..... B05B 1/00 239/492
2,544,417 A * 3/1951 Goddard ..... F23D 11/383 239/466
2,593,884 A * 4/1952 Ifield ..... F23D 11/24 239/464
2,736,607 A * 2/1956 Thompson ..... B05B 1/3415 239/462
2,746,801 A * 5/1956 Curran ..... B05B 1/3436 239/494
2,790,680 A * 4/1957 Rosholt ..... B05B 1/1654 239/394
2,805,099 A * 9/1957 Bailey ..... B05B 15/658 239/201
2,904,263 A * 9/1959 Tate ..... B05B 1/3436 239/468
2,924,394 A * 2/1960 Clark ..... B05B 1/02 239/495
3,019,990 A * 2/1962 Campbell ..... F23D 11/24 239/125
3,067,950 A * 12/1962 Goldman ..... B05B 15/622 239/276
3,120,348 A * 2/1964 O'Donnell ..... B05B 1/3436 239/490
3,182,916 A * 5/1965 Schulz ..... B05B 1/14 239/432
3,330,070 A * 7/1967 Ferm ..... A01G 13/0287 111/127
3,404,844 A * 10/1968 Walsh ..... F23D 11/408 239/406
3,792,582 A * 2/1974 Markowski ..... F02K 1/386 431/284
4,040,396 A * 8/1977 Tomita ..... F02M 61/162 239/494
4,247,049 A * 1/1981 Gailitis ..... B65D 83/20 239/497
4,313,568 A * 2/1982 Shay ..... B05B 1/12 222/380
4,471,912 A * 9/1984 Hancock ..... B05B 1/3415 239/497
4,570,860 A * 2/1986 Aprea ..... B05B 1/3415 239/478
5,906,317 A 5/1999 Srinath
5,971,301 A 10/1999 Stouffer et al.
6,076,744 A * 6/2000 O'Brien ..... B05B 1/3415 239/110
6,076,745 A * 6/2000 Primdahl ..... F23D 14/24 239/132.5
6,089,473 A * 7/2000 Keim ..... F02M 61/162 239/466
6,186,409 B1 2/2001 Srinath et al.
6,240,945 B1 6/2001 Srinath et al.
6,253,782 B1 7/2001 Raghu
6,283,387 B1 * 9/2001 Palestrant ..... B05B 1/3415 239/463
6,338,268 B1 1/2002 Stouffer
6,415,994 B1 * 7/2002 Boggs ..... B05B 1/3415 239/463
6,457,658 B2 10/2002 Srinath et al.
6,497,375 B1 12/2002 Srinath et al.
RE38,013 E 3/2003 Stouffer
6,572,570 B1 6/2003 Burns et al.
6,575,386 B1 6/2003 Thurber, Jr. et al.
6,581,856 B1 6/2003 Srinath
6,595,350 B1 7/2003 Stouffer
6,695,229 B1 * 2/2004 Heinbuch ..... F02M 61/1853 239/494
6,705,538 B2 * 3/2004 Fecht ..... B05B 7/0483 239/399
6,729,564 B2 5/2004 Srinath et al.
6,755,797 B1 6/2004 Stouffer
6,767,331 B2 7/2004 Stouffer et al.
6,796,516 B2 * 9/2004 Maier ..... F02M 51/0671 239/467
6,805,164 B2 10/2004 Stouffer
6,854,670 B2 * 2/2005 Sumisha ..... F02M 51/0678 239/468
6,904,626 B1 6/2005 Hester et al.
6,916,300 B2 7/2005 Hester et al.
6,938,835 B1 9/2005 Stouffer
6,948,244 B1 9/2005 Crockett
6,948,513 B2 9/2005 Steerman et al.
6,974,095 B2 * 12/2005 Harata ..... F02M 51/0678 239/494
6,978,951 B1 12/2005 Raghu
7,014,131 B2 3/2006 Berning et al.
7,036,749 B1 5/2006 Steerman
7,037,280 B1 5/2006 Burns et al.
7,070,129 B1 7/2006 Raghu et al.
7,111,795 B2 9/2006 Thong
7,111,800 B2 9/2006 Berning et al.
7,134,609 B1 11/2006 Stouffer et al.
7,152,808 B2 12/2006 Jenkins
7,185,831 B2 * 3/2007 Goenka ..... F02M 61/1806 239/494
7,243,861 B2 7/2007 Foubert et al.
7,267,290 B2 9/2007 Gopalan et al.
7,293,722 B1 11/2007 Srinath et al.
7,354,008 B2 4/2008 Hester et al.
7,357,565 B2 4/2008 Gopalan et al.
7,472,848 B2 1/2009 Gopalan et al.
7,478,764 B2 1/2009 Gopalan
7,478,769 B1 * 1/2009 Pautsch ..... F28D 3/04 165/104.33
7,611,080 B2 * 11/2009 Peterson ..... B05B 1/3415 239/463
7,651,036 B2 1/2010 Gopalan
7,677,480 B2 3/2010 Russell et al.
7,766,261 B1 8/2010 Santamarina et al.
7,775,456 B2 8/2010 Gopalan et al.
7,784,716 B2 * 8/2010 Fukutomi ..... F02M 51/0671 239/463
7,921,844 B1 4/2011 Santamarina et al.
7,950,077 B2 5/2011 Santamarina et al.
8,172,162 B2 5/2012 Gopalan et al.
8,205,812 B2 6/2012 Hester et al.

(56) References Cited

U.S. PATENT DOCUMENTS 8,313,046 B2 * 11/2012 Short ..... F23D 11/383 239/463
8,348,606 B2 1/2013 Gopalan et al.
8,387,171 B2 3/2013 Farber et al.
8,579,214 B2 * 11/2013 Headland ..... F23C 7/004 239/399
8,640,675 B2 * 2/2014 Ricco ..... F02M 47/027 123/467
8,662,421 B2 3/2014 Russell et al.
8,684,686 B2 4/2014 Gopalan et al.
8,702,020 B2 4/2014 Gopalan
8,770,229 B2 7/2014 Gopalan et al.
9,016,601 B2 * 4/2015 Headland ..... F23C 7/004 239/399
9,016,602 B2 * 4/2015 Grether ..... E03C 1/08 239/428.5
9,067,221 B2 6/2015 Gopalan et al.
9,089,856 B2 7/2015 Gopalan et al.
9,404,243 B2 8/2016 Cacka et al.
2003/0052197 A1 * 3/2003 Bui ..... B05B 7/0475 239/416.4
2003/0146301 A1 * 8/2003 Sun ..... B05B 1/265 239/399
2005/0242214 A1 * 11/2005 Joseph ..... F02M 61/1853 239/596
2006/0097081 A1 * 5/2006 Goenka ..... F02M 61/1806 239/533.12
2007/0290073 A1 * 12/2007 Peterson ..... B05B 1/3415 239/399
2012/0227770 A1 * 9/2012 Kaneko ..... H01L 21/67051 134/36
2013/0193234 A1 8/2013 Zhou et al.
2014/0239081 A1 * 8/2014 Schlecht ..... B05B 7/10 239/9
2016/0039596 A1 * 2/2016 Nelson ..... B05B 1/34 239/463
2016/0238255 A1 * 8/2016 Ryon ..... B05B 7/10
2016/0325293 A1 11/2016 Irwin et al.
2016/0325714 A1 * 11/2016 Yuda ..... B60S 1/52

* cited by examiner

SWIRL POT SHOWER HEAD ENGINE

CROSS REFERENCE TO EARLIER APPLICATION

This application claims priority to U.S. Provisional Application Ser. No. 62/393,735 filed on Sep. 13, 2016, the entire contents of which are hereby expressly incorporated herein by reference.

TECHNICAL FIELD

The invention relates to showerhead engine devices. More particularly, the invention relates to generating flow patterns and movement of water exiting the shower engine without the use of nozzle jets or moving parts.

BACKGROUND OF THE INVENTION

Showerheads are traditionally used to deliver water from a potable water source such as a municipal supply or a well into a bathroom shower. Many different kinds of showerheads exist to meet a wide range of needs. Some showerheads deliver a high pressure stream which is achieved by restricting the flow rate, thus increasing the pressure. Other showerheads increase the volume of water delivered, which in turn lowers the pressure of the delivered stream.

A common hurdle for any showerhead design is that state and federal laws in the United States limit the amount of water a showerhead can deliver. In order to be universally sold, a showerhead typically has to deliver no more than 2.5 gallons of water per minute. Additional limitations on water flow are also expected in the near future. As the supply of potable water pressure is typically fixed and not variable, showerhead designs are limited to the types of patterns and user experiences available to meet these strict requirements.

One known solution has been to provide the showerhead with an "engine" that manipulates the water delivery. Typical engines include turbines or nozzles that deliver a unique water delivery pattern not commonly available with a traditional showerhead. An example of a unique delivery device includes turbines within the showerhead that produce swirling patterns as the water exits the showerhead.

A known issue with these types of showerheads is that as the number of parts added to a showerhead increases, the associated costs increase as well. Additionally, moving parts such as turbines introduce potential sources of failures and a level of fragility to the showerhead. Lastly, common impurities in potable water such as minerals can lead to scaling, which over time can clog the turbine or otherwise affect the performance.

What is therefore needed is a showerhead engine that produces a unique shower experience while conforming to the traditional water flow rate delivery requirements.

What is also needed is a showerhead engine that produces movement of the water without the use of moving parts. What is also needed is a showerhead engine that produces a unique water flow experience in a cost effective manner.

SUMMARY AND OBJECT OF THE INVENTION

A shower head engine includes a back plate with an opening in fluid communication with a supply of water. A mid plate spaced apart from the back plate forms a collection chamber between the back plate and the mid plate. A first set of orifices in the mid plate at a first diameter along with a second set of orifices in the mid plate at a second diameter greater than the first diameter allow water to pass through the mid plate and into a first and second swirl chamber.

The first and second swirl chambers are formed by a front plate spaced apart from the mid plate. A separation wall extending from the mid plate separates the first swirl chamber from the second swirl chamber. A first set of holes in the front plate that are in fluid communication with the first swirl chamber and a second set of holes in the front plate in fluid communication with the second swirl chamber spray the water from the respective first and second swirl chambers.

The first set of orifices in the mid plate are formed at an angle other than normal to a front side of the mid plate such that, as water passes through the first set of orifices, it exits the front side and enters the first swirl chamber with an angular velocity, thus generating a swirling motion of the water within the first swirl chamber.

Similarly, the second set of orifices in the mid plate are formed at an angle other than normal to a front side of the mid plate such that, as water passes through the second set of orifices, it exits the front side and enters the second swirl chamber with an angular velocity, thus generating a swirling motion of the water within the second swirl chamber.

The angular velocity of the water in the first swirl chamber is in a first rotational direction (e.g., clockwise) and the angular velocity of the water in the second swirl chamber is in a second rotational direction opposite the first rotational direction (e.g., counter clockwise) such that, when the water exits the respective holes in the front plate, it exits at opposing angles producing a grid-like affect. The first and second sets of holes in the front plate are elongated slots that are normal to the face surface, which allows the angular velocity of the water within the respective swirl chambers to force the water out of the elongated slots while retaining the angular momentum and produces angled streams of water.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
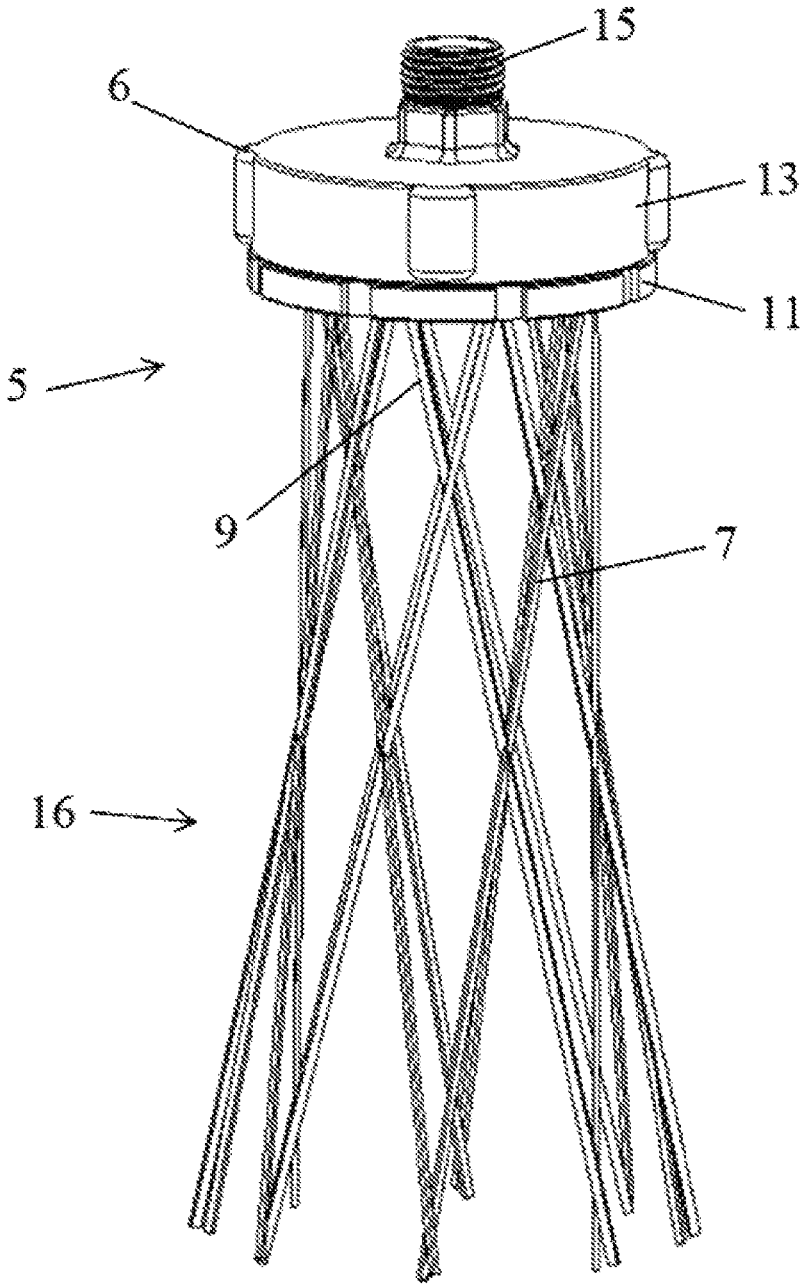
FIG. 1 is a side perspective view of a showerhead engine in use and spraying water in a lattice pattern according to an embodiment of the invention.

FIG. 1 shows a perspective view of the showerhead engine 5 according to an embodiment of the invention. The showerhead engine 5 may be implemented into a variety of showerheads. In this example, the showerhead engine 5 itself forms the showerhead 6. It is envisioned that the showerhead engine 5 may be fitted within any other showerhead to give it a different appearance.

The showerhead engine 5 produces a spray pattern 16 that is formed by a plurality of sets of water streams. In the embodiment shown, a first set of streams 7 exits the front plate 11 of the showerhead engine 5 at one angle, while a second set of streams 9 exits the front plate 11 at a different angle. The exact degree of each respective angle may be changed without departing from the nature of the invention. Preferably, the showerhead engine produces multiple streams of water at unique angles to produce a lattice or grid-like appearance.

The angled water streams are not produced by conventional nozzles which are typically angled. Instead, the showerhead engine 5 generates a swirling motion for the water between a back plate 13 and the front plate 11. The water may be introduced to the showerhead engine 5 through a threaded collar 15 as shown, but any other known fastening mechanism may be used to provide water to the showerhead engine 5.

Figure 2:
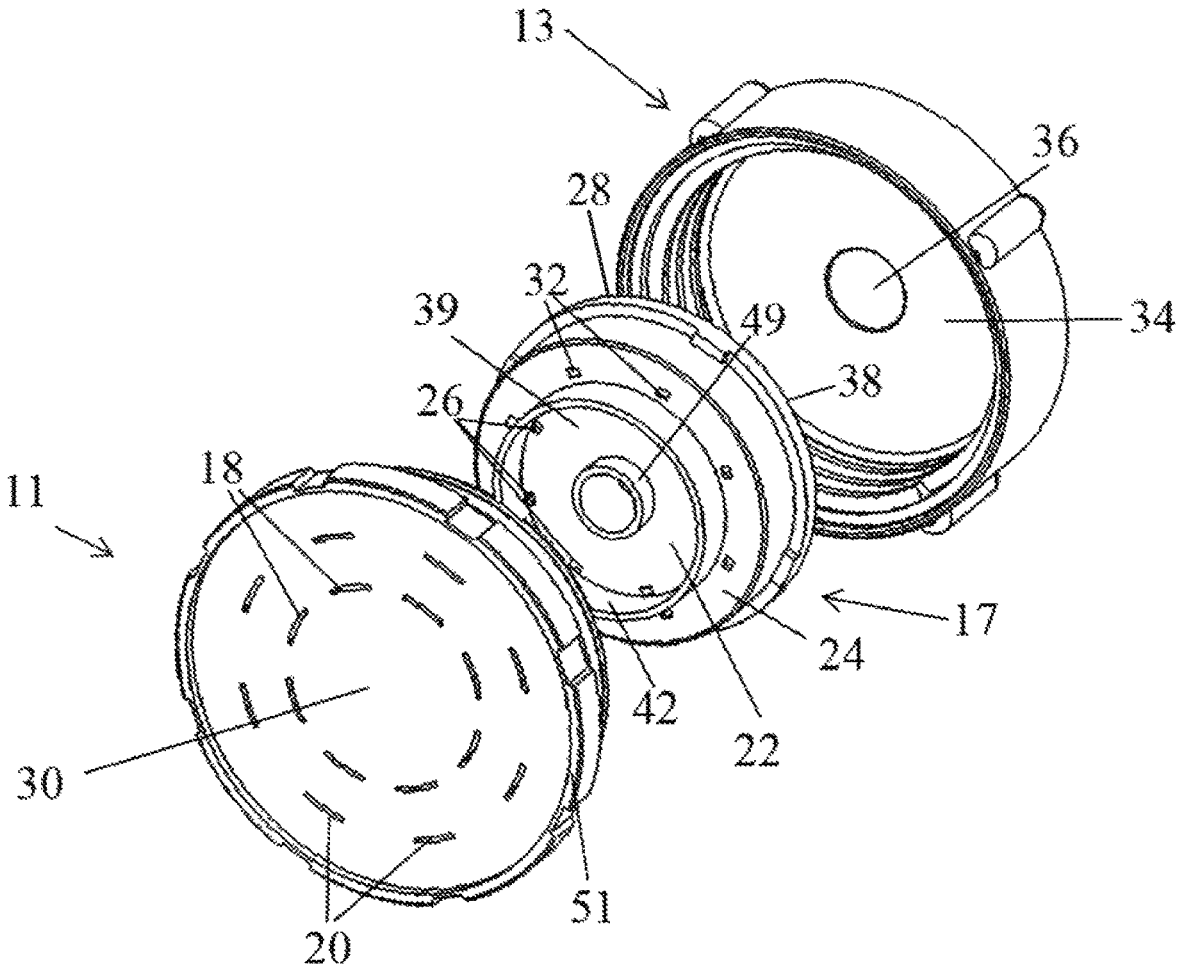
FIG. 2 is an exploded view of the showerhead engine of FIG. 1.

Looking now at FIG. 2, the showerhead engine 5 is in exploded form showing the inner workings within the back plate 13 and the front plate 11. As water enters an opening 36 in the back plate 13, it is collected within a collection chamber 34. A mid plate 17 seals against the back plate 13 by a support flange 28, thus preventing the water from bypassing the mid plate 17. As water collects in the collection chamber, it generates pressure which causes it to flow out of orifices in the mid plate 17. A first set of orifices 26 form a smaller diameter ring than a second set of orifices 32 which are axially spaced out from the center of the mid plate 17. A separation wall 42 extends from a front side 39 of the mid plate 17 separating the first set of orifices 26 from the second set of orifices 32.

The separation wall 42 allows the water that passes through the first set of orifices 26 to be kept separate from the water that passes through the second set of orifices 32. The support flange 28 abuts the front plate 11 to maintain the separation of the respective water from the first set of orifices 26 and the second set of orifices 32, thereby forming a first swirl chamber 22 and a second swirl chamber 24.

Water that enters the first swirl chamber 22 from the first set of orifices 26, and water that enters the second swirl chamber 24 from the second set of orifices 32, may be compelled to store kinetic energy. The first swirl chamber 22 may store the water and preserve its kinetic energy separately from water in the second swirl chamber 24, and vice versa. The kinetic energy may be generated in the form of water momentum by separately swirling the water around the first swirl chamber 22 and the second swirl chamber 24. In order to swirl the water, the first set of orifices 26 and the second set of orifices 32 may be formed through the thickness of the mid plate 17 at an angle other than normal to a surface of the mid plate 17.

Figure 3:
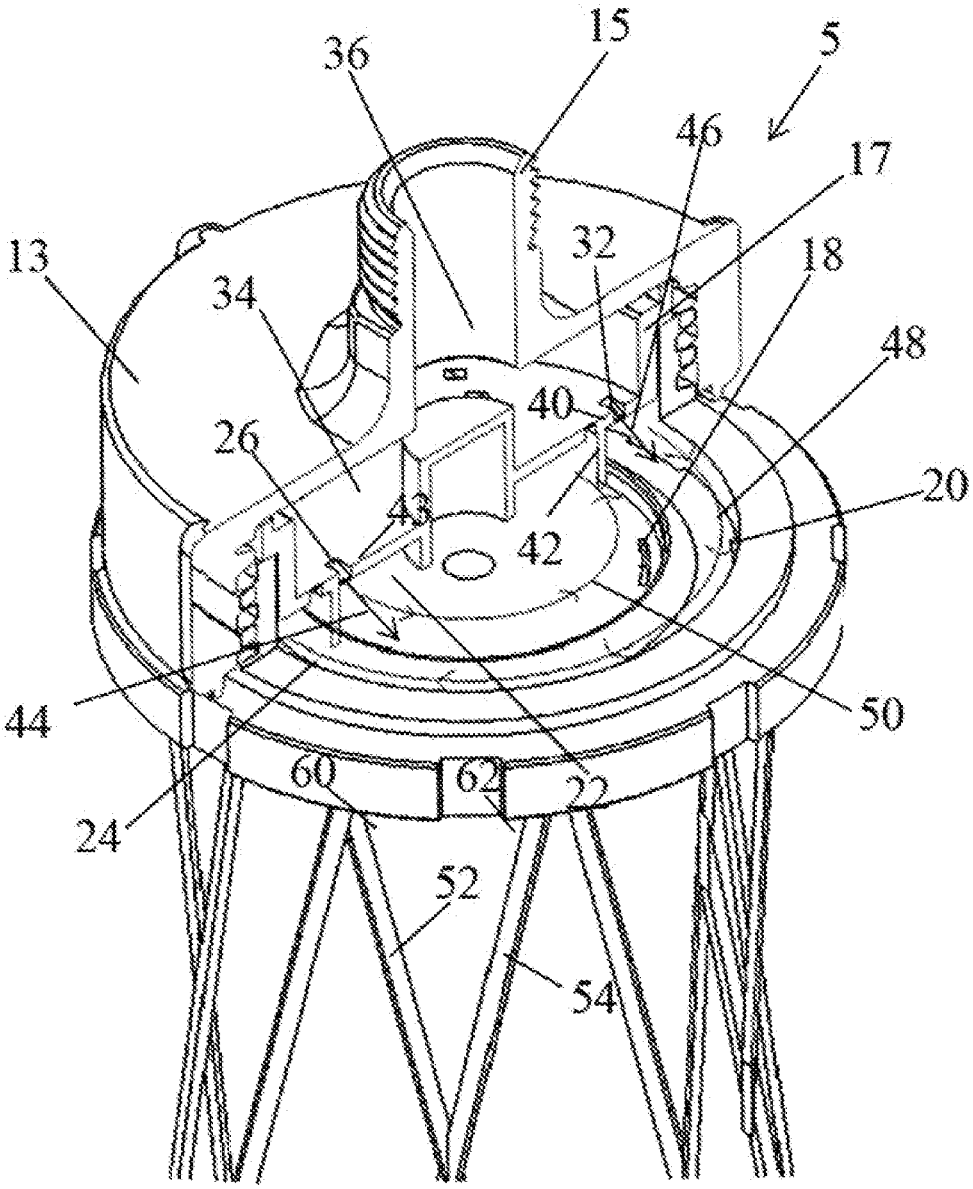
FIG. 3 is a cross sectional view of the showerhead engine of FIG. 1.

For example, looking to FIG. 3, a representation of the showerhead engine 5 is shown. The back plate 13 allows water to collect in the collection chamber 34 prior to passing through the mid plate 17. As shown in the representation, the first set of orifices 26 are formed at an angle 43 with respect to the surface of the mid plate 17. Similarly, the second set of orifices 32 are formed through the mid plate 17 at an angle 40 which is different than angle 43. The angle 43 of the first set of orifices 26 thereby produces a water jet 44 that is angled. The angle 40 of the second set of orifices 32 also produces a water jet 46 that is also angled, but note the direction of each respective water jet. The different angles produce water jets in different directions.

The first swirl chamber 22, best shown in FIG. 2, causes water to swirl within the separation wall 42 and a center wall 49. Each of the respective walls 42, 49 includes a curvature, which compels the water jet 44 to run alongside of the walls 42, 49. The result is a swirling motion 48 (in this case, generally circular) which is influenced by and follows a rotational direction consistent with the angled direction of the water jet 44.

Similarly, the second swirl chamber 24, best shown in FIG. 2, causes water to swirl within the separation wall 42 and the front plate wall 51. Each respective wall 42, 51 also includes a curvature, which compels the water jet 46 to run alongside of the walls 42, 51. The result is a swirling motion 50 (in this case, also generally circular) which is influenced by and follows a rotational direction consistent with the angled direction of the water jet 46.

During operation, the water within the first swirl chamber 22 and the second swirl chamber 24 continues to swirl, building up momentum and an angular velocity. The respective angular velocities are shown in the form of the swirling motions 48, 50. As the pressure builds, the water exits through a first set of holes 18 and a second set of holes 20. The first set of holes 18 expels water within the first swirling chamber 22 in the form of a water jet 52 at an angle 60. The second set of holes 20 expels water within the second swirling chamber 24 in the form of a water jet 54 at a different angle 62. The angles of water jets 52 and 54 are generated as a result of the swirling motion within the respective swirl chambers and not, for example, by an angled shape of the first and second sets of holes 18, 20.

Preferably, the first set of holes 18 and the second set of holes 20 are in the form of elongated slots as shown in FIG. 2. The slots are preferably extended along the arc of the swirling motion, which allows the exiting water to maintain angular velocity as it passes through a face surface 30 of the front plate 11.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A showerhead engine comprising:

a back plate with an opening in fluid communication with a supply of water;

a mid plate spaced apart from the back plate forming a collection chamber between the back plate and the mid plate;

a first set of orifices in the mid plate at a first diameter;

a second set of orifices in the mid plate at a second diameter greater than the first diameter;

a front plate spaced apart from the mid plate forming a first swirl chamber and a second swirl chamber between the front plate and the mid plate;

a separation wall extending from the mid plate separating the first swirl chamber from the second swirl chamber;

a first set of holes in the front plate in fluid communication with the first swirl chamber;

a second set of holes in the front plate in fluid communication with the second swirl chamber; and wherein the first set of orifices and the second set of orifices are angled such that they impart a swirling motion to water from the supply of water within the first swirl chamber and the second swirl chamber, respectively.

2. The showerhead engine according to claim 1, wherein the first set of orifices in the mid plate are formed at an angle other than normal to a front side of the mid plate such that, as water passes through the first set of orifices, it exits the front side and enters the first swirl chamber with an angular velocity, thus generating a swirling motion of the water within the first swirl chamber.

3. The showerhead engine according to claim 1, wherein the second set of orifices in the mid plate are formed at an angle other than normal to a front side of the mid plate such that, as water passes through the second set of orifices, it exits the front side and enters the second swirl chamber with an angular velocity, thus generating a swirling motion of the water within the second swirl chamber.

4. The showerhead engine according to claim 1, wherein the first set of orifices in the mid plate and the second set of orifices in the mid plate are each respectively formed at different angles other than normal to a front side of the mid plate such that, as water passes through the first and second set of orifices, it exits the front side and enters the first and second swirl chambers with an angular velocity, thus generating a swirling motion of the water within the first and second swirl chambers.

5. The showerhead engine according to claim 4, wherein the angular velocity of the water in the first swirl chamber is clockwise and the angular velocity of the water in the second swirl chamber is counter clockwise.

6. The showerhead engine according to claim 1, wherein water exits the first and second set of holes in the front plate at an angle other than normal to a front surface of a face surface of the front plate.

7. The showerhead engine according to claim 6, wherein the first and second set of holes in the front plate are elongated slots that are normal to the face surface.

8. A showerhead engine comprising:

a back plate with an opening configured for fluid communication with a supply of water;

a mid plate, with a plurality of orifices through parallel surfaces, secured at least partially within a recess formed into the back plate;

a support flange extending around a perimeter of the mid plate configured to engage the recess in the back plate such that the supply of water flows through the plurality of orifices in the mid plate, the plurality of orifices comprising a first set of orifices and a second set of orifices;

wherein the first set of orifices are formed through the mid plate at an angle less than normal to the parallel surfaces of the mid plate and wherein the second set of orifices are formed through the mid plate at an angle greater than normal to the parallel surfaces of the mid plate;

a front plate with a face surface spaced apart from the mid plate forming a first swirl chamber for water exiting the first set of orifices and a second swirl chamber for water exiting the second set of orifices;

a separation wall between the front plate and the mid plate separating the first swirl chamber from the second swirl chamber;

a first set of holes in the front plate in fluid communication with the first set of orifices configured to each deliver a stream of water at an angle less than normal to the face surface of the front plate; and a second set of holes in the front plate in fluid communication with the second set of orifices configured to each deliver a stream of water at an angle greater than normal to the face surface of the front plate.

9. The showerhead engine according to claim 8, wherein the first set of orifices in the mid plate and the second set of orifices in the mid plate are each respectively formed at different angles other than normal to a front side of the mid plate such that as water passes through the first and second set of orifices it exits the front side and enters the first and second swirl chambers with an angular velocity thus generating a swirling motion of the water within the first and second swirl chambers.

10. The showerhead engine according to claim 9, wherein the angular velocity of the water in the first swirl chamber is clockwise and the angular velocity of the water in the second swirl chamber is counter clockwise.

11. The showerhead engine according to claim 8, wherein water exits the first and second set of holes in the front plate at an angle other than normal to a front surface of the face surface of the front plate.

12. The showerhead engine according to claim 8, wherein the plurality of orifices includes the first set of orifices in the mid plate, each at a distance from a center of the mid plate and the second set of orifices in the mid plate, each at a second distance from the center of the mid plate, wherein the second distance is greater than the first distance.

13. The showerhead engine according to claim 8, wherein the separation wall extends from the mid plate between the first set of orifices and the second set of orifices, and wherein the water within the first swirl chamber is kept separate from the water in the second swirl chamber by the separation wall.

14. The showerhead engine according to claim 13, wherein the water within the first swirl chamber flows clockwise, thus exiting the first set of holes at a first angle, and wherein the water within the second swirl chamber flows counter clockwise, thus exiting the second set of holes at a second angle different than the first angle.

15. A swirl chamber for a showerhead engine comprising:

a mid plate with parallel front and back sides with a separation wall extending from the front side of the mid plate;

a plurality of orifices through the mid plate formed at an angle other than normal to the front and back sides of the mid plate, wherein the separation wall separates the plurality of orifices based upon their respective angles;

a support flange extending from the front side of the mid plate separating a portion of the plurality of orifices;

a back plate engaging the back side of the mid plate with an opening configured for fluid communication with a supply of water;

a front plate with a face surface spaced apart from the mid plate forming a first and a second swirl chamber for water exiting the plurality of orifices in the mid plate, wherein the first swirl chamber includes the plurality of orifices at a first angle and the second swirl chamber includes the plurality of orifices at a second angle;

a plurality of holes formed through the front plate in communication with the first and second swirl chambers configured to deliver the water from the first and second swirl chambers at varying angles other than normal to the face surface.

16. The swirl chamber according to claim 15, wherein the plurality of orifices comprises a first set of orifices in the mid plate and a second set of orifices in the mid plate, each respectively formed at different angles other than normal to a front side of the mid plate such that, as water passes through the first and second set of orifices, it exits the front side and enters the first and second swirl chambers with an angular velocity, thus generating a swirling motion of the water within the first and second swirl chambers.

17. The swirl chamber according to claim 16, further comprising a separation wall extending from the mid plate between the first set of orifices and the second set of orifices, and wherein the water within the first swirl chamber is kept separate from the water in the second swirl chamber by the separation wall.

18. The swirl chamber according to claim 16, wherein the water exiting the plurality of orifices in the front plate from the first and second swirl chambers exits at multiple angles.

19. The swirl chamber according to claim 16, wherein the water in the first and second swirl chambers moves with an angular velocity such that it exits the plurality of orifices in the front plate at an angle.

20. The swirl chamber according to claim 16, wherein the plurality of orifices in the front plate is elongated slots.

* * * * *